US010851515B2

(12) United States Patent
McKernan

(10) Patent No.: US 10,851,515 B2
(45) Date of Patent: Dec. 1, 2020

(54) SKIRT FOR FORMING AN ACCESS HATCH IN CONCRETE

(71) Applicant: EJ USA, Inc., East Jordan, MI (US)

(72) Inventor: Timothy J. McKernan, Baldwinsville, NY (US)

(73) Assignee: EJ USA, Inc., East Jordan, MI (US)

( * ) Notice: Subject to any disclaimer, the term of this patent is extended or adjusted under 35 U.S.C. 154(b) by 88 days.

(21) Appl. No.: 16/301,964

(22) PCT Filed: May 27, 2016

(86) PCT No.: PCT/US2016/034529

§ 371 (c)(1),
(2) Date: Nov. 15, 2018

(87) PCT Pub. No.: WO2017/204815

PCT Pub. Date: Nov. 30, 2017

(65) Prior Publication Data

US 2019/0257055 A1 Aug. 22, 2019

(51) Int. Cl.
*E02D 29/14* (2006.01)
*B28B 7/16* (2006.01)

(52) U.S. Cl.
CPC ..... *E02D 29/14* (2013.01); *B28B 7/16* (2013.01); *E02D 2250/0007* (2013.01); *E02D 2250/0023* (2013.01); *E02D 2300/002* (2013.01)

(58) Field of Classification Search
CPC ..... B28B 7/164; B28B 7/186; B29C 33/12; B29C 33/123; E02D 29/14
USPC ..... 249/142, 83; 404/25, 26; 52/19, 21, 52/2.15, 742.1; 246/35
See application file for complete search history.

(56) References Cited

U.S. PATENT DOCUMENTS 2,539,917 A * 1/1951 McKinley ..... B28B 7/186 249/13
3,611,889 A * 10/1971 Levinson ..... E02D 29/1409 404/26
5,136,811 A 8/1992 Lyons, Sr.
(Continued)

OTHER PUBLICATIONS

"Forming Skirts—The EJ Innovation that Became an Industry Standard" (EJ USA) [online] (retrieved from the Internet on Aug. 4, 2016) <URL http://americas.ejco.com/forming-skirts/>, Aug. 4, 2016(Aug. 4, 2016).
(Continued)

*Primary Examiner* — Paola Agudelo
(74) *Attorney, Agent, or Firm* — Warner Norcross + Judd LLP

(57) ABSTRACT

A skirt supports an access hatch at a predetermined height as the hatch is formed in concrete. The skirt can be permanently embedded in the concrete. The skirt includes a rigid frame defining a central opening, the frame has an inner surface and an outer surface opposite the inner surface. The frame defines a height between the upper edge and the lower edge. The height of the skirt is predetermined such that the combined height of the skirt and the hatch approximate the desired thickness of the concrete slab. The skirt may include an alignment tab extending from the frame at an angle with respect to the frame, with the alignment tab extending above the upper edge of the frame to guide the hatch into alignment with the upper edge of the frame as the hatch is moved into position on the skirt.

16 Claims, 10 Drawing Sheets

(56) References Cited

U.S. PATENT DOCUMENTS 5,800,143 A * 9/1998 Bravo ..... B67D 7/78 141/86
5,800,648 A * 9/1998 House ..... E02D 29/12 156/71
6,088,972 A * 7/2000 Johanneck ..... E04G 15/061 285/4
6,811,350 B2 11/2004 Nadasde
6,939,078 B1 9/2005 Anderson et al.
7,134,805 B2 11/2006 Yee
7,484,908 B2 2/2009 Stadler
2003/0037489 A1 2/2003 McKeman
2003/0039510 A1* 2/2003 Kuan ..... E02D 29/1409 404/25
2007/0145640 A1* 6/2007 Jones ..... B28B 7/0017 264/299
2009/0324329 A1* 12/2009 Choi ..... E02D 29/1454 404/26
2010/0077681 A1* 4/2010 McCleskey ..... H02G 3/088 52/220.1
2013/0031840 A1* 2/2013 Carralero ..... E06B 1/52 49/394
2013/0097933 A1* 4/2013 Royer ..... E02D 29/14 49/394
2013/0212954 A1* 8/2013 Taylor ..... E05C 3/34 52/19
2014/0123560 A1* 5/2014 Boca ..... E02D 29/1463 49/394
2015/0376860 A1* 12/2015 Saeki ..... E02D 29/149 404/25
2016/0145826 A1* 5/2016 Armstrong ..... E02D 29/14 182/93
2016/0215474 A1* 7/2016 Royer ..... E02D 29/14
2016/0290035 A1* 10/2016 Boss ..... E02D 29/14

OTHER PUBLICATIONS

"Forming Skirt Flyer" (EJ USA) [online] (retrieved from the Internet on Aug. 4, 2016) <URL http://go.pardot.com/109092/2015-12-04/2tqnd/109092/7391/forming_skirt_flyertg>, Dec. 4, 2015 (Dec. 4, 2015).

"Access Hatch Solutions" (EJ) [online] (retrieved from the Internet on Sep. 20, 2016) <URL https://americas.ejco.com/wcsstore/EJIW-USA/EJIWAssets/Brochures%20&%20Sell%20Sheets/Content_AccessHatchBrochure_2012_LR_6-5-13.pdf>, May 6, 2013 (May 6, 2013).

* cited by examiner

SKIRT FOR FORMING AN ACCESS HATCH IN CONCRETE

BACKGROUND OF THE INVENTION

The present invention is directed to the forming of items into a slab of precast concrete, and, more specifically, to the forming of an access hatch into a slab of precast concrete.

Precast, or preformed concrete is well known. In general, a form is made in the desired shape of the concrete, and then concrete is poured into the form and let to cure in the shape of the form. After the concrete has cured, the form can be removed and the slab of concrete can be transported for use in a final application. In many cases, there is a desire to insert one or more structural elements into the slab of concrete. For example, if the slab of concrete is to be placed over an opening, there is often a desire to include an access hatch in the slab of concrete to provide access to the opening after the slab of concrete has been placed.

Access hatches are also well known. These hatches generally include a rigid outer frame, often cast iron, that defines a central access opening. A cover attaches to the frame for covering the access opening. The cover can be opened to provide access to the opening, for example, by pivoting the cover on one or more hinges formed into the frame. In situations where a hatch is to be inserted into a concrete slab, the hatch is transported and lowered into the concrete form prior to the pouring of concrete, and then the concrete is poured into the form around the outer frame. When the concrete has cured, the hatch is embedded in the concrete slab and can be transported with the slab to the final application for insertion over an opening.

Problems can arise when forming a hatch into concrete, because hatches generally have a standard height of about five inches. In many cases, the desired height of the concrete is greater than five inches, such as eight, ten or twelve inches. In order to position the hatch in the form at the desired height of the surface of the concrete, a special form is typically made. The form is generally made from wood or Styrofoam with a height that can raise the hatch to the desired level of the concrete, such that the form is placed in the concrete form, and then the hatch is lowered onto the form. After the concrete has been poured and cured, the hatch must be opened and then the wood or Styrofoam form must be removed from the lower surface of the slab to provide access to the hatch opening. This process of creating, inserting and removing a special temporary form for raising the hatch to a desired height is both time consuming and laborious.

SUMMARY OF THE INVENTION

The present invention provides a skirt that supports a hatch at a predetermined height as the hatch is formed within a slab of concrete. The skirt can be embedded and retained in the concrete. The skirt may include features for assisting in the placement of the hatch and the formation of the concrete.

In one embodiment, the skirt includes a rigid frame including a sidewall defining a central opening, the sidewall has an inner surface facing the central opening, an outer surface opposite the inner surface, an upper edge and a lower edge opposite the upper edge, the sidewall defines a height between the upper edge and the lower edge. The height of the skirt is predetermined such that the combined height of the skirt and the hatch approximate the desired thickness of the concrete slab.

The skirt may include an alignment tab extending from the sidewall at an angle with respect to the sidewall, at least a portion of the alignment tab extending beyond and above the upper edge of the sidewall such that the alignment tab guides the hatch into alignment with the upper edge of the sidewall as the hatch is moved into position on the upper edge of the sidewall. In one embodiment, the alignment tab includes an inner plate extending from the inner surface of the sidewall and an outer plate extending from the outer surface of the sidewall. In another embodiment, the inner plate extends at an angle from the inner surface and the outer plate extends at an angle from the outer surface, the inner and outer plates together forming a V-shape that converges toward the upper edge of the sidewall.

In another embodiment, the skirt includes at least one retention tab extending outwardly from the outer surface of the sidewall and spaced apart from the alignment tab. The retention tab may have a hook shape to assist in retaining the skirt within the concrete when the concrete has been poured and cured.

In another embodiment, the skirt includes a flange extending outwardly from the outer surface of the sidewall and spaced from the alignment tab and the retention tab, the flange is positioned on the sidewall such that it aligns underneath an opening in the hatch and closes the opening to prevent the flow of concrete into the opening when the hatch is seated on the skirt.

The present invention also provides a method for forming a hatch into precast concrete, comprising: providing a concrete form; placing a rigid skirt frame into the concrete form, the frame including a sidewall defining a central skirt opening, the sidewall having an inner surface facing the central opening, an outer surface opposite the inner surface, an upper edge and a lower edge opposite the upper edge, the sidewall defining a height between the upper edge and the lower edge; placing a hatch onto the skirt frame, the hatch having a frame defining a central hatch opening, the hatch frame including an inner surface facing the central hatch opening, an outer surface, an upper edge and a bottom edge defining a hatch height, the bottom edge of the hatch seated on the top edge of the skirt frame, the central hatch opening aligned with the central skirt opening, the hatch having a cover for covering the central hatch opening; and pouring concrete into the concrete form around the outer surface of the skirt and the outer surface of the hatch.

DETAILED DESCRIPTION OF THE CURRENT EMBODIMENTS

I. Overview

Figure 1:
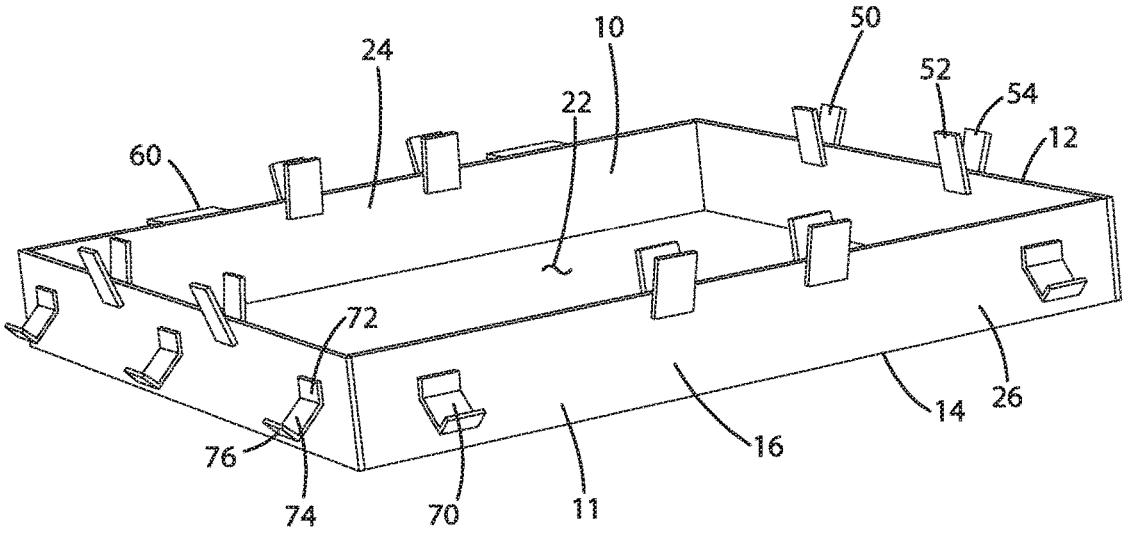
FIG. 1 is top perspective view of a skirt according to one embodiment of the present invention.

A skirt for forming an access hatch in precast concrete is shown in FIG. 1 and generally designated 10. The skirt 10 is a generally rigid open frame having an upper edge 12 and a lower edge 14 defining a height 16 therebetween. The height 16 may be predetermined to correspond to a desired height of a preformed slab of concrete 18 into which the hatch 20 is to be formed, such that the combined height of the skirt 10 and the hatch 20 matches the height of the concrete. The skirt 10 includes features for aligning the hatch 20 on the skirt 10, and for preventing the flow of concrete into certain areas of the hatch 20, and also for preventing the removal of the skirt 10 from the concrete 18.

II. Structure

Figure 2:
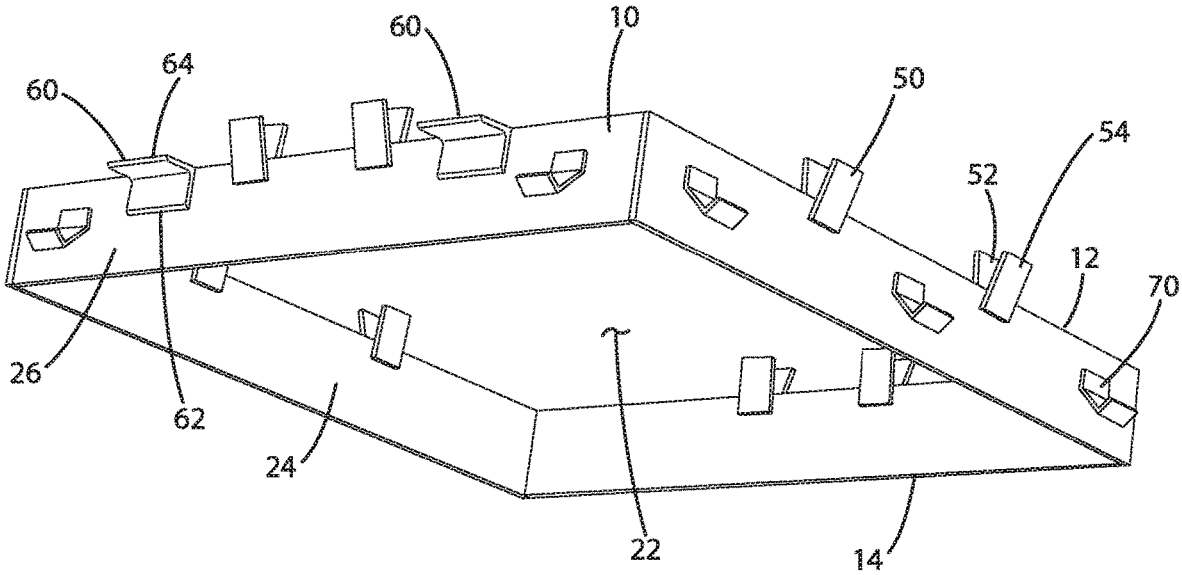
FIG. 2 is a bottom perspective view thereof.

As shown in FIGS. 1 and 2, the skirt 10 is a frame having a sidewall 11 defining a central opening 22 for aligning with an opening in the hatch 20. The frame is formed from a rigid material, such as aluminum, that can maintain its shape when supporting the weight of a cast iron hatch 20. In one embodiment, the skirt 10 includes an upper edge 12 and a lower edge 14 defining a height 16 therebetween. An inner surface 24 faces the central opening 22, and an outer surface 26 faces away from the central opening 22. In the illustrated embodiment, the skirt 10 is rectangular in shape, but it should be known that the shape can change from application to application.

Figure 3:
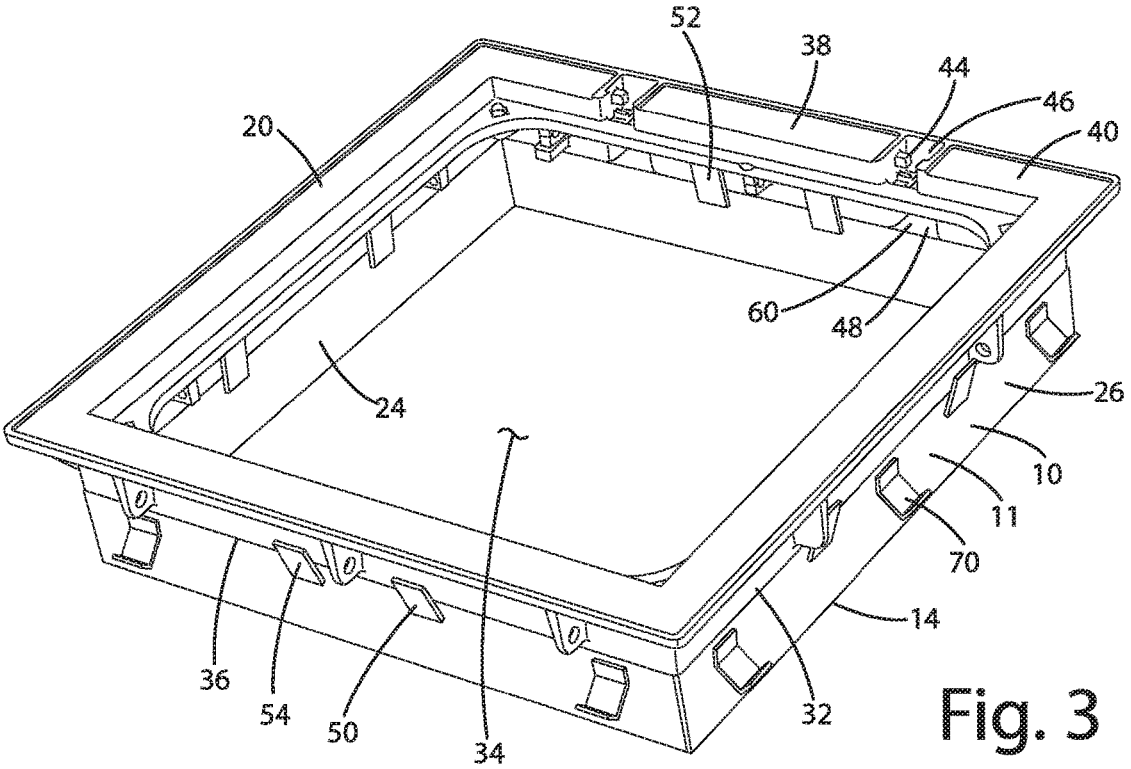
FIG. 3 is a top perspective view of a hatch frame and skirt.
Figure 4:
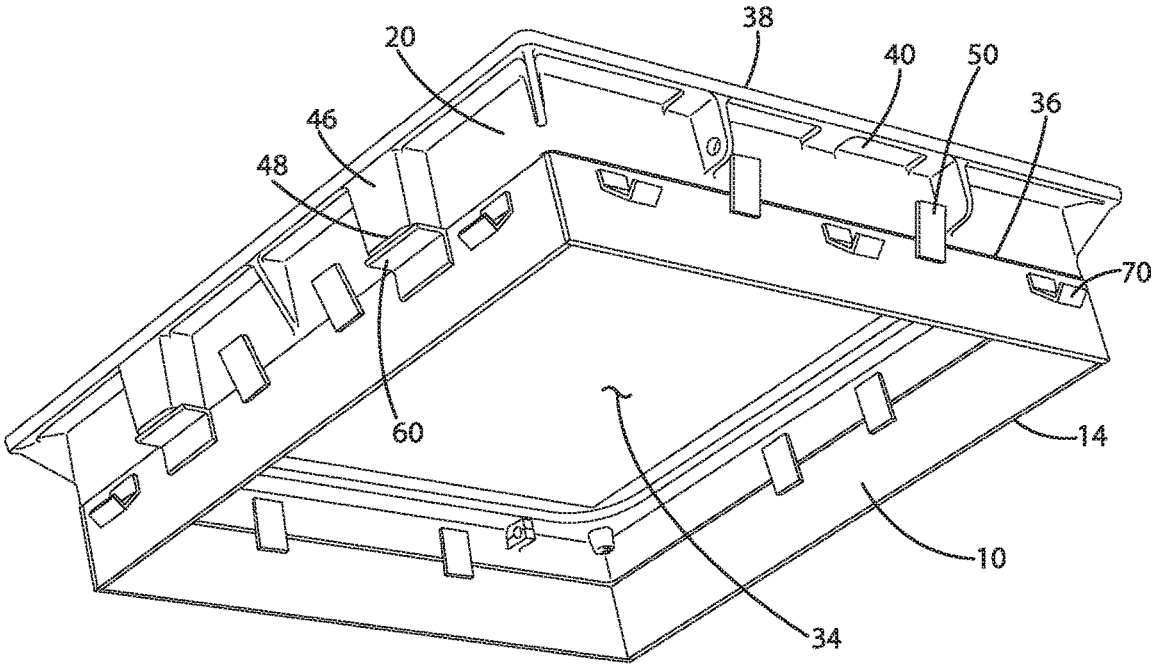
FIG. 4 is a bottom perspective view of a hatch frame and skirt.

The skirt 10 is designed to support a generally conventional hatch 20 in a precast concrete form 30 (described in more detail below). For example, the hatch 20 may be seated on the upper edge 12 of the skirt 10 when in the form 30 to raise the height of the hatch 20 to be generally flush with the surface of the concrete 18. Referring to FIGS. 3 and 4, the hatch 20 also includes a sidewall 32 defining a central opening 34. The sidewall 11 of the skirt 10 is designed to match the size and shape of the sidewall 32 of the hatch 20 such that the hatch 20 can be placed on the skirt 10 with the respective sidewalls 11, 32 being generally flush with one another or at least with portions of sidewall 11 of the skirt 10 being sufficiently aligned with the sidewalls 32 of the hatch 20 to support the weight of the hatch 20 when the hatch 20 is placed on the skirt 10. As further illustrated in FIGS. 3 and 4, the hatch 20 may include a bottom edge 36 and a top edge 38 opposite the bottom edge 36. In the illustrated embodiment, a flange 40 extends outwardly from the top edge 38 in a direction perpendicular to the sidewall 32 forming an upper surface of the hatch 20.

As shown in FIGS. 7-12, the hatch 20 also includes a cover 42 that can be closed to extend over and cover the central opening 34 of the hatch 20 and opened to provide access to the central opening 34. In one embodiment, the cover 42 attaches to the sidewall 32 (or another portion of the hatch 20) with one or more hinges 44. As shown, the hinges 44 are formed within U-shaped cutouts 46 in the flange 40, and in one embodiment these cutouts 46 include an open bottom 48 that is exposed to the environment. Although the cover 42 is shown in a closed position in FIGS. 7-12, it should be known that the cover 42 can be pivoted about the hinges 44 from this closed position to an open position about a pivot axis that extends through the hinges 44.

The skirt 10 may include one or more structural features that assist in the process of forming a slab of concrete 18 around the stacked hatch 20 and skirt 10. In one example, shown in FIGS. 1-4 and 6, the skirt includes one or more alignment tabs 50 extending from the sidewall 11 of the skirt 10. These alignment tabs 50 function to guide the hatch 20 into alignment with the skirt 10 as the hatch 20 is lowered onto the skirt 10. In one embodiment, each alignment tab 50 includes a pair of plates 52, 54, with a first plate 52 extending from the inner surface 24 and a second plate 54 extending from the outer surface 26. The plates 52, 54 extend at an angle from the skirt 10 and beyond the upper edge 12 of the skirt to form a V-shape that converges towards the upper edge 12 of the skirt 10, wherein each plate 52, 54 acts as a ramp to guide the hatch 10 into alignment on the upper edge 12 of the skirt 10. In the illustrated embodiment, the plates 52, 54 of each alignment tab 50 are positioned directly across from one another, and a series of alignment tabs 50 are spaced apart about the sidewall 11. In another embodiment, each alignment tab 50 may include only a single one of the plates 52 or 54. For example, a plate 52 on the inner surface 24 of the skirt 10 may be spaced along the sidewall 11 from a plate 54 on the outer side 26 of the sidewall 11.

In one embodiment, the skirt 10 may include one or more flanges 60 extending outwardly to align with one or more regions of the hatch 20 to prevent the unwanted flow of concrete into those regions. Referring to FIGS. 2 and 4, in the illustrated embodiment the skirt 10 includes a pair of flanges 60 that are positioned on the sidewall 11 of the skirt 10 such that they each align underneath an open bottom 48 of one of the U-shaped hinge cutouts 46 to close off the open bottom 48 when the hatch 20 is seated on the skirt 10 and prevent the flow of concrete 18 into the hinge cutout 46. The flanges 60 thus keep the U-shaped cutouts 46 clear of concrete as the concrete is poured to enable full operation of the hinges after the concrete 18 sets. In this embodiment, the flanges 60 are L-shaped, including a first generally vertical leg 62 abutting flat against the sidewall 11 of the skirt and a section generally horizontal leg 64 extending at about a 90 degree angle from the first leg 62 in a direction away from the sidewall 11. The horizontal leg 64 is flush with the upper edge 12 of the skirt such that the open bottom 48 of the hinge cutouts 46 abuts the horizontal leg 64 of the flange 60. In another embodiment, other shapes and sizes of flanges may be positioned on the skirt 10 to align with other structures on the hatch 10 in order to prevent the unwanted flow of concrete into such structures.

Figure 6:
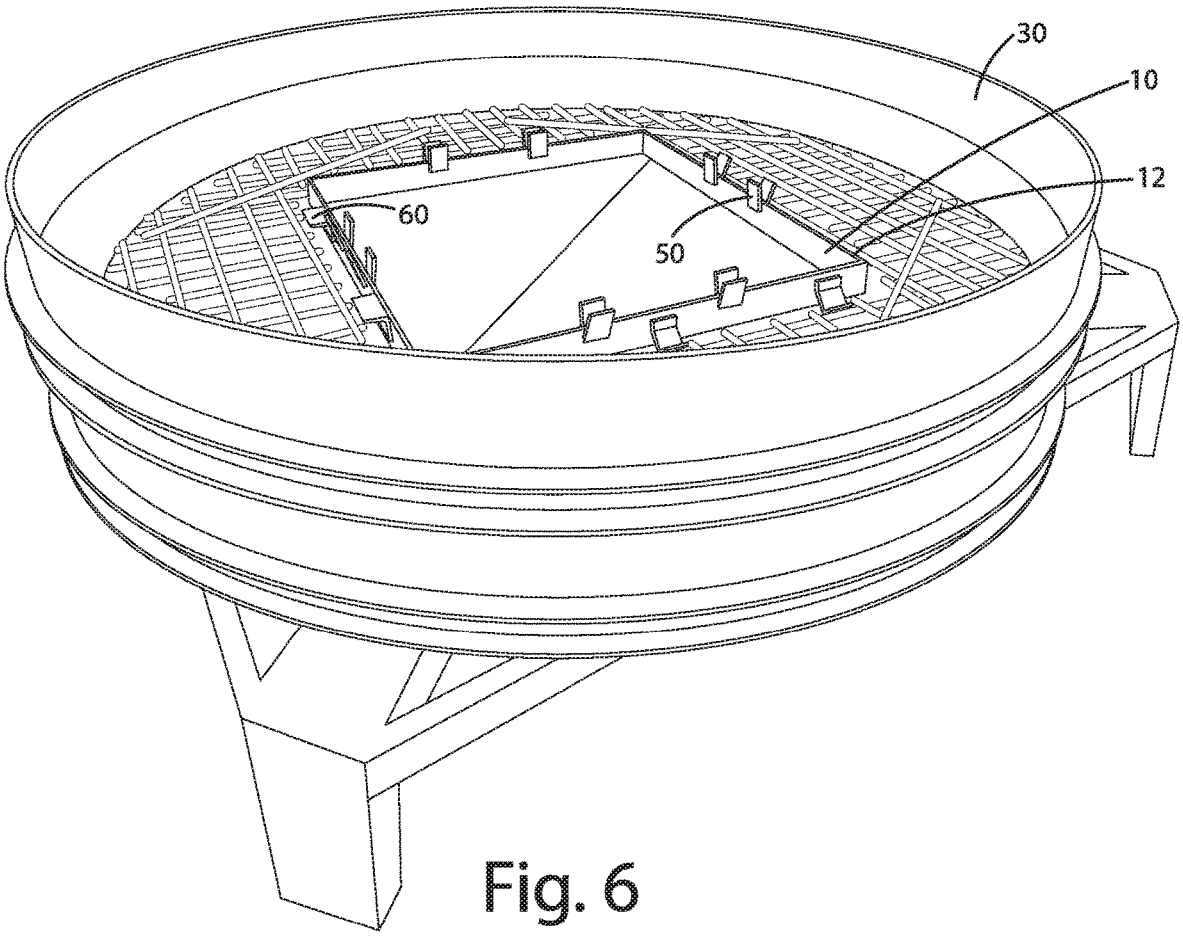
FIG. 6 is a view of a skirt positioned within the form.

Referring again to FIGS. 1-4, and also FIG. 6, the skirt 10 may include structural features to prevent the movement or removal of the skirt 10 from the concrete 18 after the concrete 18 has cured. As illustrated, the skirt 10 includes retention flanges 70 extending outwardly from the outer surface 26 of the skirt 10. The retention flanges 70 are spaced apart along each side of the sidewall 11, with either three retention flanges 70 or two retention flanges 70 per side. Each retention flange includes a first portion 72 connected to the sidewall 11 and positioned flat against the sidewall 11, a second portion 74 extending outwardly at an angle from the first portion 72, and a third portion 76 extending at an angle from the second portion 74 and in a generally upward direction, such that each retention flange 70 has a hook shape. The retention flanges 70 are spaced apart from the alignment tabs 50 and the flanges 60. In an alternative embodiment, the retention flanges 70 may be differently shaped, sized or spaced.

Figure 10:
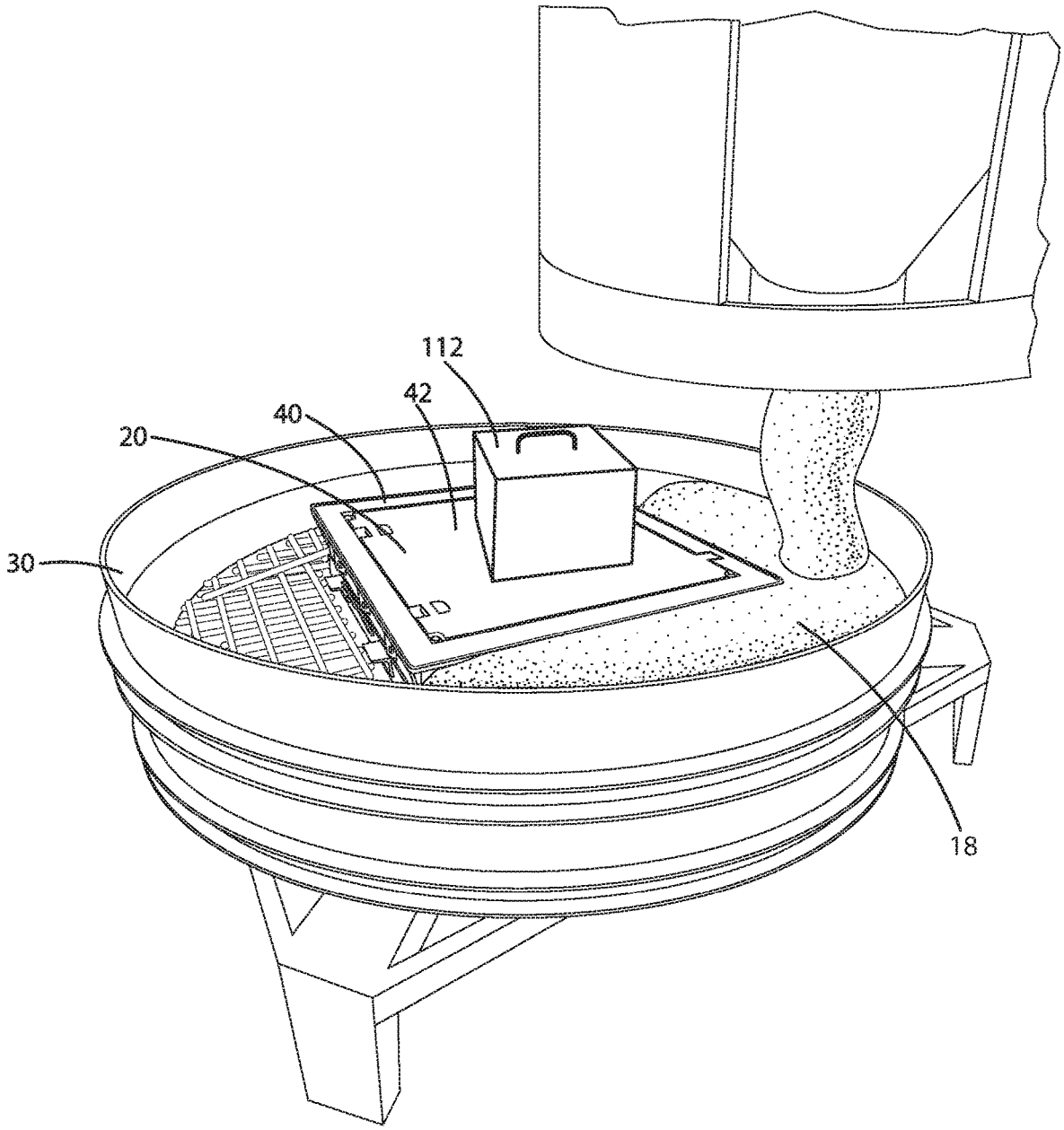
FIG. 10 is a view of the concrete being poured into the form with the hatch positioned on the skirt.
Figure 11:
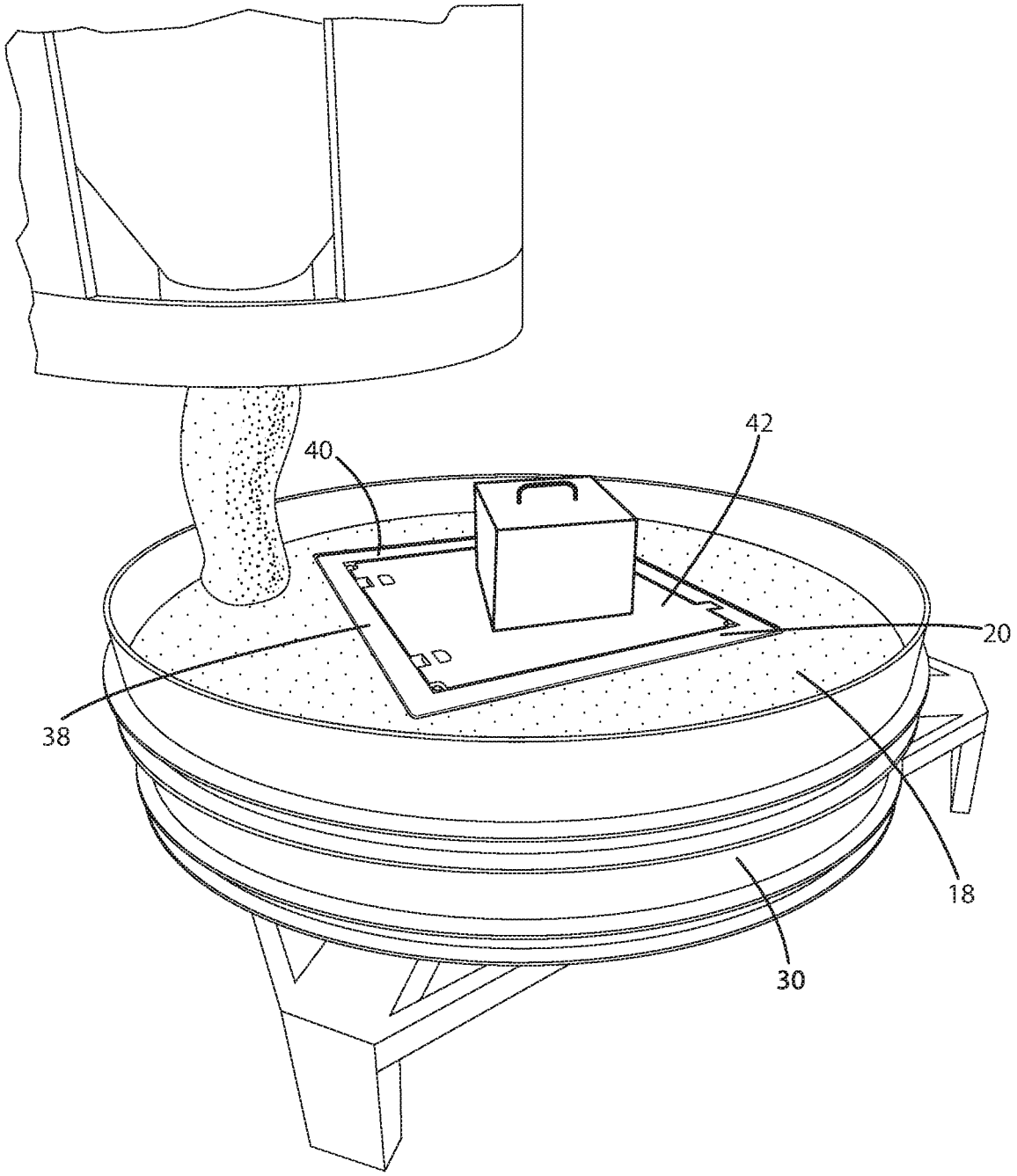
FIG. 11 is a view of the concrete poured into the form.
Figure 12:
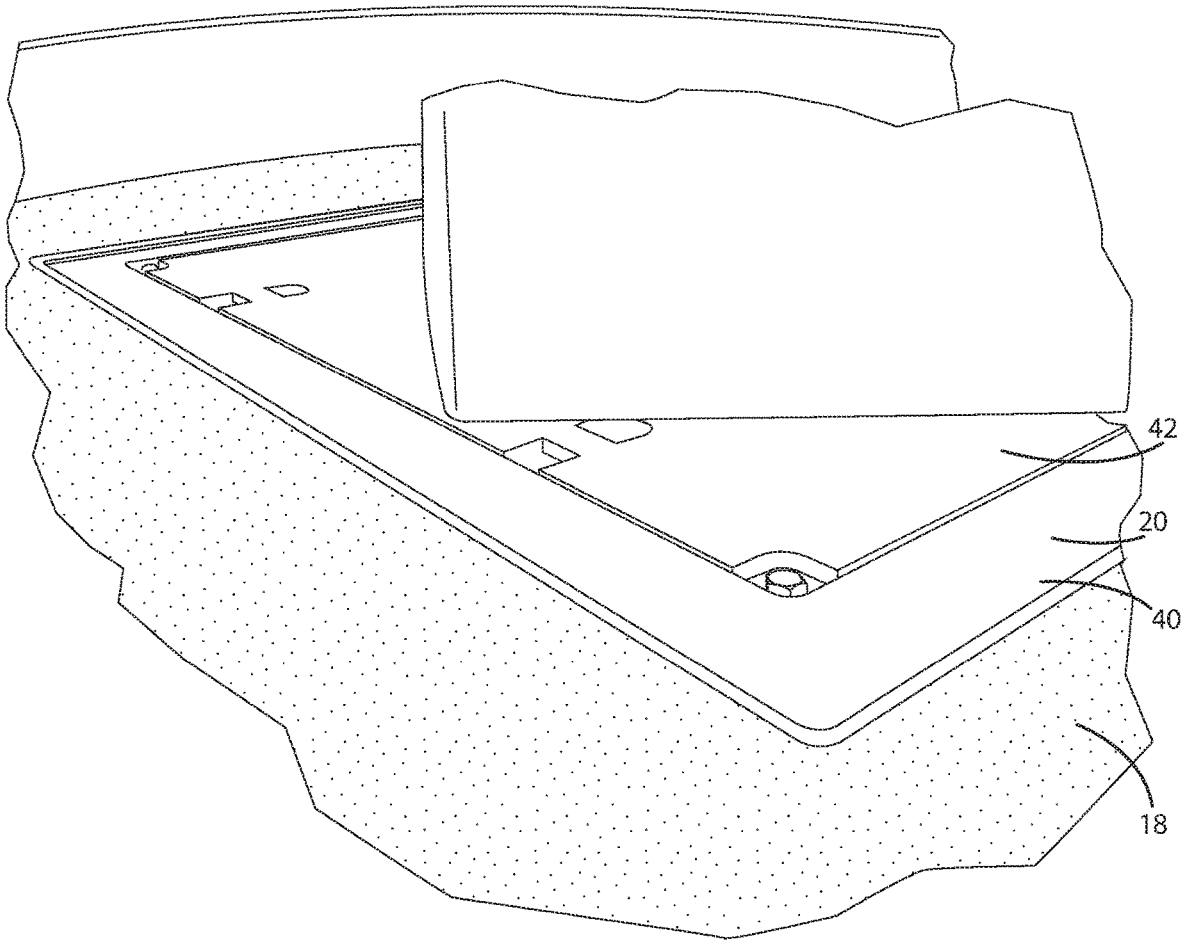
FIG. 12 is a close up view of the concrete poured about the hatch.

FIGS. 10-12 show examples of the hatch 20 with skirt 20 formed into a concrete slab 18. As shown, the height 16 of the skirt 10 is such that the lower edge 14 of the skirt 10 is positioned on the bottom of the concrete form 30, and thus at the bottom of the concrete slab 18, while the top flange 40 of the hatch 20 being generally flush with the top of the concrete form and thus the top of the concrete slab 18.

III. Manufacture

Manufacture of a precast slab of concrete 18 with embedded hatch 20 and skirt 10 is shown in FIGS. 5-12.

Figure 5:
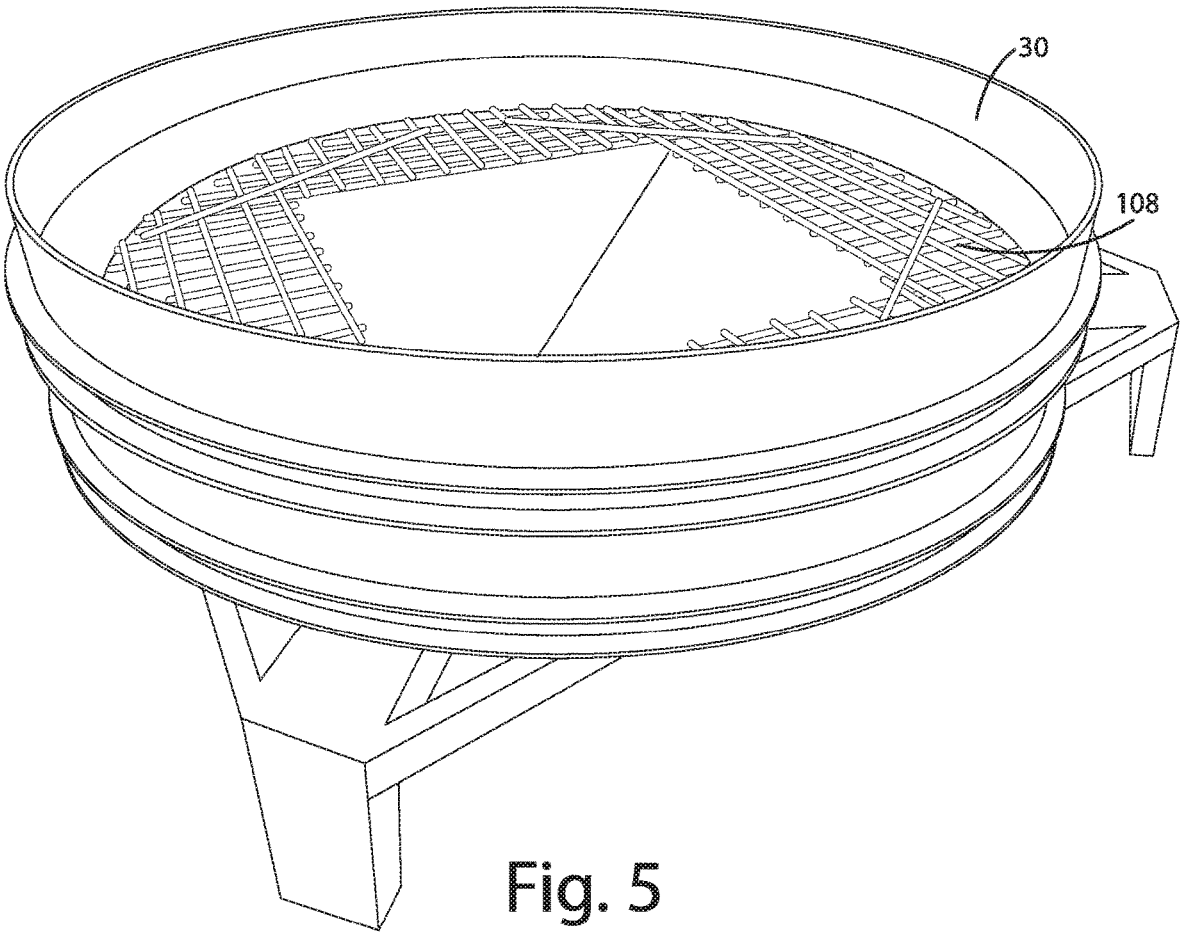
FIG. 5 is a view of a concrete form.

FIG. 5 shows a conventional concrete form 30. The form 30 is circular, and is lined with rebar 108. FIG. 6 shows a skirt 10 positioned in the concrete form 30.

Figure 7:
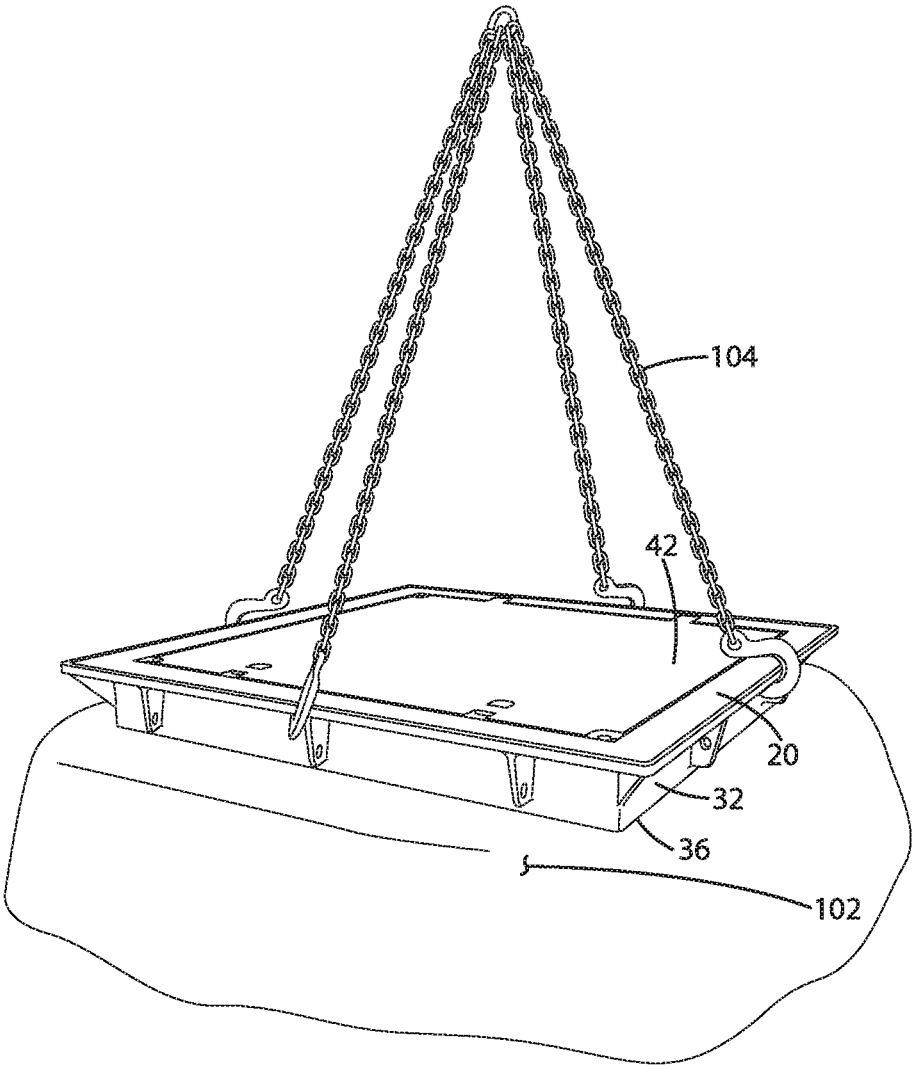
FIG. 7 is a view of a hatch prepared to be transported to the form.

FIG. 7 shows a generally conventional hatch 20 positioned on a shelf 102 with lift chains 104 connected to the hatch 20 for movement of the hatch 20. The hatch cover 42 is in a closed position, and the sidewall 32 of the hatch 20 is oriented vertically with the bottom edge 36 seated on the shelf 102.

Figure 8:
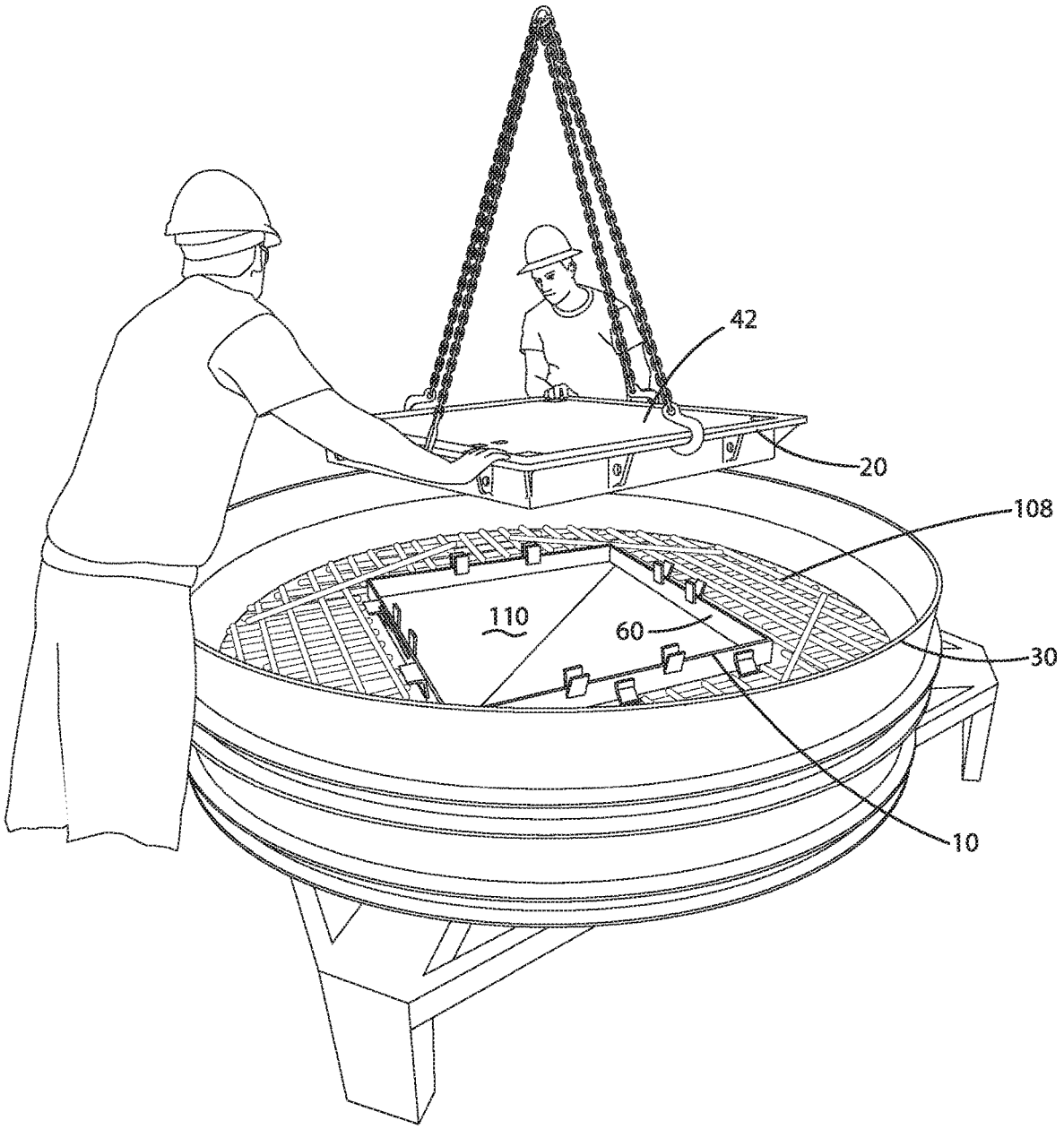
FIG. 8 is a view of the hatch being transported to the form.

FIG. 8 shows the hatch 20 being transported into position above the concrete form 30. The form 30 is circular, and is lined with rebar 108. The skirt 10 is positioned in the form 30 at the bottom 110 of the form 30 with the alignment tabs 50 extending upwardly.

Figure 9:
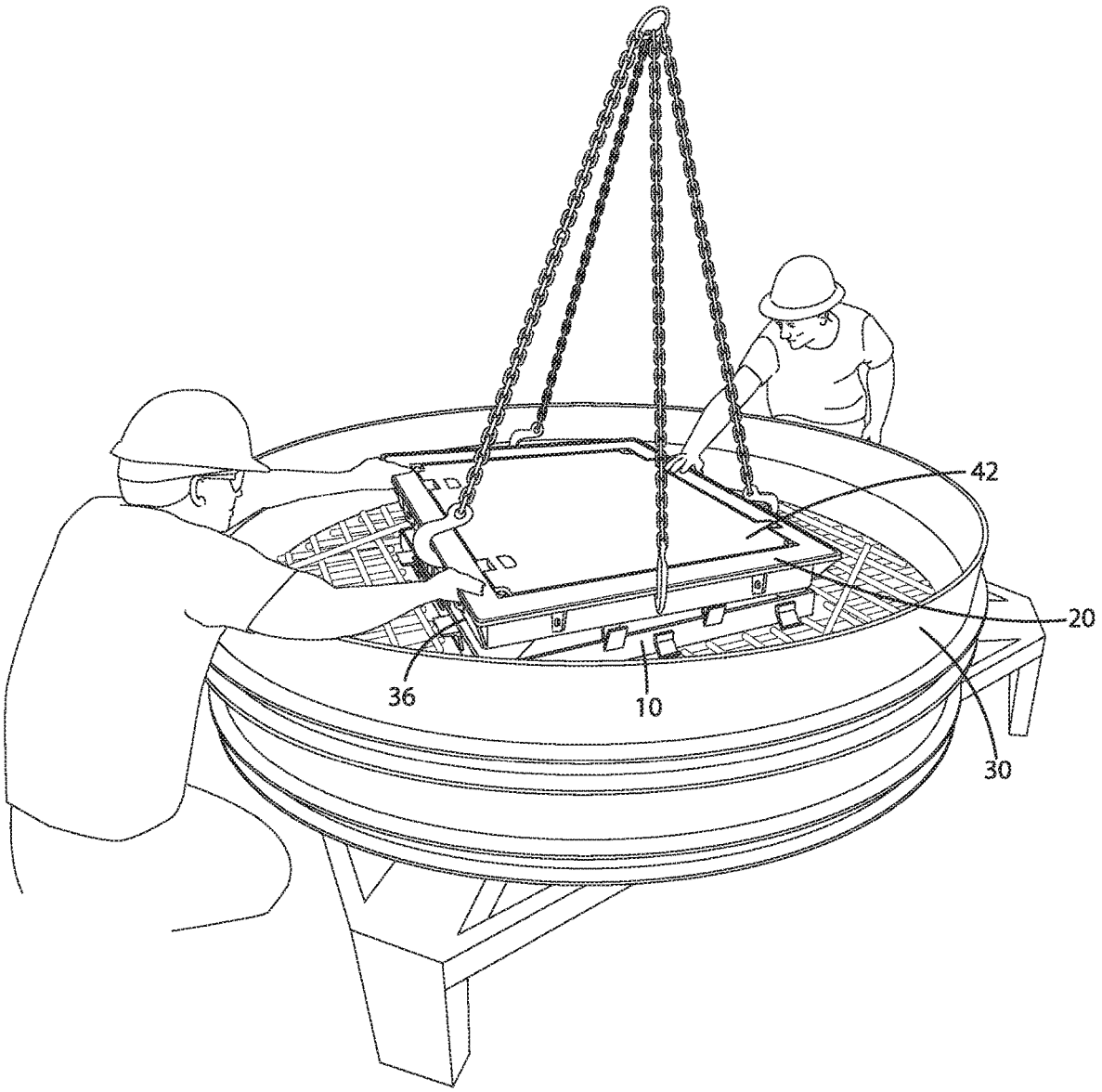
FIG. 9 is a view of the hatch being lowered into position above the skirt and form.

FIG. 9 shows the hatch 20 being lowered onto the skirt 10, with the bottom edge 36 of the hatch 20 generally aligned above the upper edge 12 of the skirt 10. As the hatch 20 continues to be lowered, the sidewall 32 of the hatch 20 extends between the plates 52, 54 of the alignment tabs 50 and is guided into alignment with the sidewall 11 of the skirt 10 with each wall of the sidewall 11 of the hatch 10 being aligned underneath a corresponding wall of the sidewall 32 of the hatch 20.

FIG. 10 shows the hatch 20 in position on top of the skirt 10, with the bottom edge 36 of the hatch 20 seated on the upper edge 12 of the skirt (similar to the arrangement shown in FIGS. 3 and 4). Weights 112 are placed on top of the hatch 20 to hold the hatch 20 in place. Concrete 18 is dispensed into the form 30. As the concrete 18 is dispensed into the form 30, the flanges 60 prevent the flow of concrete 18 into the hinge cutouts 46 and the retention flanges 70 project outwardly into the flow of concrete such that the concrete 18 flows around the hook shaped retention flanges 60 to prevent the removal of the skirt 10 from the concrete 18 after the concrete 18 has cured.

FIGS. 11 and 12 show the concrete form 30 filled with concrete 18 such that the concrete 18 is generally level with the top edge 38 and flange 40 of the hatch 20. Once cured, the concrete 18 can be removed from the form 30 with the hatch 20 and skirt 10. The skirt 10 remains generally embedded in the concrete 18 and does not need to be removed from the concrete 18.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A skirt for supporting a hatch formed in concrete, the skirt comprising:

a rigid frame including a sidewall defining a central opening, the sidewall having an inner surface facing the central opening, an outer surface opposite the inner surface, an upper edge and a lower edge opposite the upper edge, the sidewall defining a height between the upper edge and the lower edge; and an alignment tab extending from the sidewall at an angle with respect to the sidewall, at least a portion of the alignment tab extending beyond and above the upper edge of the sidewall such that the alignment tab guides the hatch into alignment with the upper edge of the sidewall as the hatch is moved into position on the upper edge of the sidewall, wherein the alignment tab includes an inner plate extending from the inner surface of the sidewall and an outer plate extending from the outer surface of the sidewall.

2. The skirt of claim 1 wherein the inner plate extends at an angle from the inner surface and the outer plate extends at an angle from the outer surface, the inner and outer plates together forming a V-shape that converges toward the upper edge of the sidewall.

3. The skirt of claim 1 including at least one retention tab extending outwardly from the outer surface of the sidewall and spaced apart from the alignment tab.

4. A skirt for supporting a hatch formed in concrete, the skirt comprising:

a rigid frame including a sidewall defining a central opening, the sidewall having an inner surface facing the central opening, an outer surface opposite the inner surface, an upper edge and a lower edge opposite the upper edge, the sidewall defining a height between the upper edge and the lower edge; and an alignment tab extending from the sidewall at an angle with respect to the sidewall, at least a portion of the alignment tab extending beyond and above the upper edge of the sidewall such that the alignment tab guides the hatch into alignment with the upper edge of the sidewall as the hatch is moved into position on the upper edge of the sidewall, wherein the frame includes a flange extending outwardly from the outer surface of the sidewall and spaced from the alignment tab and the retention tab, the flange positioned on the sidewall such that it aligns underneath an opening in the hatch and closes the opening to prevent the flow of concrete into the opening when the hatch is seated on the skirt.

5. A method for forming a hatch into precast concrete, comprising:

providing a concrete form;

placing a rigid skirt frame into the concrete form, the frame including a sidewall defining a central skirt opening, the sidewall having an inner surface facing the central opening, an outer surface opposite the inner surface, an upper edge and a lower edge opposite the upper edge, the sidewall defining a height between the upper edge and the lower edge;

placing a hatch onto the skirt frame, the hatch having a frame defining a central hatch opening, the hatch frame including an inner surface facing the central hatch opening, an outer surface, an upper edge and a bottom edge defining a hatch height, the bottom edge of the hatch seated on the top edge of the skirt frame, the central hatch opening aligned with the central skirt opening, the hatch having a cover for covering the central hatch opening;

pouring concrete into the concrete form around the outer surface of the skirt and the outer surface of the hatch;

filling the concrete form with concrete to a level generally equal to the combined height of the skirt frame and the hatch frame;

providing at least one alignment tab extending from the skirt frame beyond the upper edge of the skirt frame, wherein the step of placing the skirt frame on the hatch frame includes guiding the bottom edge of the hatch frame onto the upper edge of the skirt frame with the alignment tab; and wherein the at least one alignment tab includes a pair of plates arranged in a V-shape that converges towards the upper edge of the skirt frame.

6. The method of claim 5 wherein the skirt frame includes at least one retention tab extending outwardly from the outer surface of the skirt frame, and wherein the concrete is poured around the at least one retention tab, the retention tab having a hook shape.

7. The method of claim 6 wherein the hatch includes a hinge for connecting the cover to the hatch frame, the hinge disposed in a cutout in the hatch frame, the cutout having an open bottom, and wherein the skirt frame includes at least one flange extending outwardly therefrom and spaced from the retention tab and the alignment tab, the hatch frame placed on the skirt with the at least one flange closing the open bottom of the cutout, preventing the flow of concrete into the cutout as the concrete is poured into the form.

8. The method of claim 7 wherein the flange is flush with the upper edge of the skirt.

9. A system for forming a hatch into concrete, comprising:

a rigid skirt frame including a sidewall defining a central skirt opening, the sidewall having an inner surface facing the central opening, an outer surface opposite the inner surface, an upper edge and a lower edge opposite the upper edge, the sidewall defining a height between the upper edge and the lower edge; and a hatch seated on the skirt frame, the hatch having a frame defining a central hatch opening, the hatch frame including an inner surface facing the central hatch opening, an outer surface, an upper edge and a bottom edge defining a hatch height therebetween, the bottom edge of the hatch seated on at least a portion of the top edge of the skirt frame, the central hatch opening aligned with the central skirt opening;

a cover for covering the central hatch opening, and a hinge for connecting the cover to the hatch frame, the hinge disposed in a cutout in the hatch frame, the cutout having an open bottom, wherein the skirt frame includes at least one flange extending outwardly therefrom, the hatch frame placed on the skirt with the at least one flange closing the open bottom of the cutout.

10. The system of claim 9 including an alignment tab extending from the skirt frame at an angle with respect to the sidewall, at least a portion of the alignment tab extending beyond and above the upper edge of the skirt frame such that the alignment tab can guide the hatch into alignment with the upper edge of the skirt frame as the hatch is moved into position on the upper edge of the sidewall of the skirt frame.

11. The system of claim 10 wherein the alignment tab includes an inner plate extending from the inner surface of the skirt frame and an outer plate extending from the outer surface of the skirt frame.

12. The system of claim 11 wherein the inner plate extends at an angle from the inner surface and the outer plate extends at an angle from the outer surface, the inner and outer plates together forming a V-shape that converges toward the upper edge of the skirt frame.

13. The system of claim 12 including at least one retention tab extending outwardly from the outer surface of the skirt frame and spaced apart from the alignment tab.

14. The system of claim 13 wherein the retention tab has a hook shape.

15. The system of claim 14 wherein the flange extending outwardly from the skirt frame is and spaced from the alignment tab and the retention tab.

16. The system of claim 15 wherein the flange is flush with the upper edge of the skirt frame.

* * * * *